US012269561B2

(12) United States Patent
Parniske et al.

(10) Patent No.: US 12,269,561 B2
(45) Date of Patent: Apr. 8, 2025

(54) FOLD ASSIST BIMINI TOP

(71) Applicant: Lippert Components, Inc., Elkhart, IN (US)

(72) Inventors: Dennis J. Parniske, Parrish, FL (US); Daniel J. Serafini, Churubusco, IN (US)

(73) Assignee: LIPPERT COMPONENTS, INC., Elkhart, IN (US)

( * ) Notice: Subject to any disclaimer, the term of this patent is extended or adjusted under 35 U.S.C. 154(b) by 443 days.

(21) Appl. No.: 17/743,772

(22) Filed: May 13, 2022

(65) Prior Publication Data

US 2022/0396336 A1 Dec. 15, 2022

Related U.S. Application Data

(60) Provisional application No. 63/187,984, filed on May 13, 2021.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02
USPC ..... 114/361
See application file for complete search history.

(56) References Cited

U.S. PATENT DOCUMENTS

| | | | | |
|---|---|---|---|---|
| 1,289,265 | A | 12/1918 | Richard et al. | |
| 3,354,892 | A | 11/1967 | Frieder | |
| 4,683,900 | A | 8/1987 | Carmichael | |
| 7,311,060 | B1 | 12/2007 | Giblin et al. | |
| 7,438,015 | B1 | 10/2008 | Schwindaman | |
| 7,921,797 | B2 | 4/2011 | James | |
| 7,950,342 | B2 * | 5/2011 | Russikoff | B63B 17/02 114/361 |
| 9,783,267 | B1 | 10/2017 | Alexander et al. | |
| 10,858,072 | B1 | 12/2020 | Riordan et al. | |
| 11,465,714 | B2 * | 10/2022 | Mazzarelli | B63B 17/02 |
| 11,919,609 | B2 * | 3/2024 | Mazzarelli | B63B 17/02 |

* cited by examiner

*Primary Examiner* — Lars A Olson
(74) *Attorney, Agent, or Firm* — NIXON & VANDERHYE P.C.

(57) ABSTRACT

A fold assist bimini top includes a bimini frame with a front bow, a front support, a rear bow, and a rear support. The bimini frame is displaceable between an extended position and a retracted position. A canopy secured over the bimini frame is displaceable with the bimini frame between the extended position and the retracted position. A pair of assist straps are configured to facilitate displacement of the bimini frame from the extended position to the retracted position. One of the pair of assist straps is manually displaceable, and one of the assist straps is elastic and is secured at ends thereof to the bimini frame. The elastic assist strap biases the bimini frame toward the retracted position.

20 Claims, 4 Drawing Sheets

FOLD ASSIST BIMINI TOP

CROSS-REFERENCES TO RELATED APPLICATIONS

This application claims the benefit of U.S. Provisional Patent Application No. 63/187,984, filed May 13, 2021, the entire content of which is herein incorporated by reference.

STATEMENT REGARDING FEDERALLY SPONSORED RESEARCH OR DEVELOPMENT (NOT APPLICABLE)

BACKGROUND

The invention relates to a bimini top and, more particularly, a bimini top incorporating fold assist structure to facilitate displacement of the bimini to a retracted position.

A bimini top is traditionally an open-front cover assembly including a top made of canvas or other suitable material for the cockpit of a vehicle such as a boat. The canopy is supported on a framework that is extendable into a use position and retractable into a stowed position.

Releasing a bimini top from the extended use position can be difficult due to the tension in the canvas and the secure framework that supports the canvas. With the use of middle bimini bows or supports for the canvas, without properly retracting the middle bimini supports, the canopy may be subjected to bow "scissoring" resulting in canopy fabric pinch damage.

SUMMARY

The fold assist bimini top of the described embodiments utilizes assist straps to facilitate retraction of the bimini top from the extended position to the retracted or stowed position.

The fold assist system includes a manual pulling strap and an elastic cord. The strap may be connected between the front bow and the front support and is looped or knotted to be secured at the front support. The strap exits through a hole in a front support pocket of the canopy, extends forward to bridge over the front bow, and then exits the front of the bimini canopy through a front access hole. The strap can be pulled downward or backward from the front of the bimini to urge the frame into the stowed position. The strap can similarly be pulled forward to deploy the bimini frame. A handle at the front of the strap may include a hook and loop fastener for securing the strap around the front bow and attaching to an intermediate part of the strap to secure the strap when not in use.

The elastic cord may be connected between the rear bow and the rear support. The elastic bow is looped or knotted to be secured at the rear support, exits through a hole in a rear support pocket of the canopy, and then extends rearward to snap to the rear bow using an incorporated "toggle" with an attached snap. The elastic cord is stretched when the bimini is in the deployed or extended position, and the elastic cord relaxes as the framework is released to assist in urging the frame and canopy into the stowed position.

The storage assist system allows the rear bow of the bimini to self-retract, while the front bow manually retracts using the integrated assist strap. The system also allows the support bows to retract during the storage process to prevent bow "scissoring" and resulting fabric pinch damage.

In an exemplary embodiment, a fold assist bimini top includes a bimini frame including a front bow, a front support, a rear bow, and a rear support, a canopy secured over the bimini frame, an assist strap connected to the front support and contained between the front bow and the canopy, and an assist bungee connected to the rear support and attachable to the rear bow. The bimini frame is displaceable between an extended position and a retracted position, and the assist bungee biases the rear support toward the retracted position.

The assist strap may be displaceable relative to the front bow. The assist strap and the front support may be configured such that displacement of the assist strap relative to the front bow displaces the front support relative to the front bow. The assist bungee and the rear support may be configured such that displacement of the assist strap relative to the front bow activates the assist bungee to displace the rear support relative to the rear bow.

The front support may be pivotably attached to the front bow at a front pivot joint, wherein the assist strap may be secured to the front support at a position spaced from the front pivot joint. The rear support may be pivotably attached to the rear bow at a rear pivot joint, and the assist bungee may be secured to the rear support at a position spaced from the rear pivot joint.

The assist bungee may be selectively attachable to the rear bow.

The assist bungee may include a snap connector, and the assist bungee may be snap-connected to the rear bow. The assist bungee may include a toggle.

The assist strap or the canopy may include a first part of a releasable connector on an inside surface, and an end of the assist strap may include a second part of the releasable connector that may be selectively engageable with the first part.

The front bow may include two legs and a cross bar connected between the two legs, and the assist strap may engage the cross bar of the front bow.

The assist strap may be threaded over the front bow and through a front access opening in the canopy.

In another exemplary embodiment, a fold assist bimini top includes a bimini frame including a front bow, a front support, a rear bow, and a rear support, where the bimini frame is displaceable between an extended position and a retracted position. A canopy secured over the bimini frame is displaceable with the bimini frame between the extended position and the retracted position. A pair of assist straps are configured to facilitate displacement of the bimini frame from the extended position to the retracted position. One of the pair of assist straps is manually displaceable, and one of the assist straps is elastic and is secured at ends thereof to the bimini frame. The elastic assist strap biases the bimini frame toward the retracted position.

In yet another exemplary embodiment, a method of displacing a bimini top supported on a deck surface via a deck pivot joint to a retracted position includes the steps of (a) detaching the bimini frame from the deck surface except for the deck pivot joint; and (b) pulling downward on the assist strap to displace the front bow toward the rear bow and pivoting the bimini frame on the deck pivot joint toward the retracted position. The method may further include, after step (b), manually displacing the bimini frame to the retracted position. The method may further include biasing the rear support toward the rear bow with the assist bungee.

BRIEF DESCRIPTION OF THE DRAWINGS

These and other aspects and advantages will be described in detail with reference to the accompanying drawings, in which.

DETAILED DESCRIPTION

Figure 1:
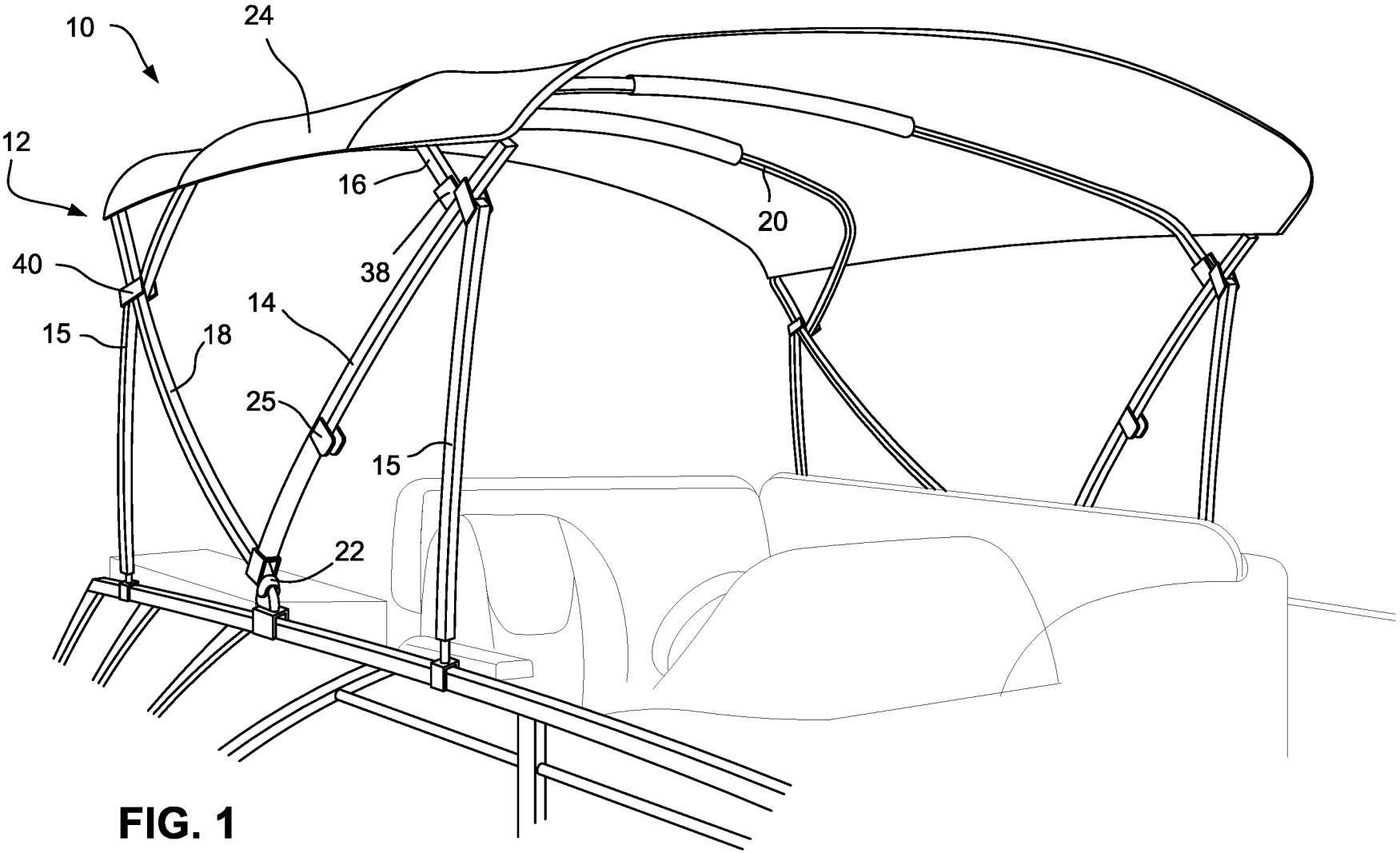
FIG. 1 shows an exemplary bimini top including the fold assist system of the described embodiments.

FIG. 1 shows an exemplary bimini top incorporating the fold assist system of the described embodiments. The fold assist bimini top 10 includes a bimini frame 12 with a front bow 14, a front support 16 pivotably secured to the front bow 14, a rear bow 18, and a rear support 20 pivotably secured to the rear bow 18. The front bow 14 may be pivotably connected to the rear bow 18, and the front bow 14 and the rear bow 18 are secured on the boat deck via a pivot joint 22. A fabric canopy 24 is secured over the bimini frame 12.

In some embodiments, the bimini frame 12 may be provided with front and rear stanchions 15 that connect to the deck to support the bimini top 10. The front and rear bows 14, 18 may be provided with a bracket 25 to stow the stanchions 15 when not in use. Other structures may be suitable for supporting the bimini frame in the extended position, and the invention is not meant to be limited to the exemplary stanchions 15 shown in FIG. 1.

Figure 2:
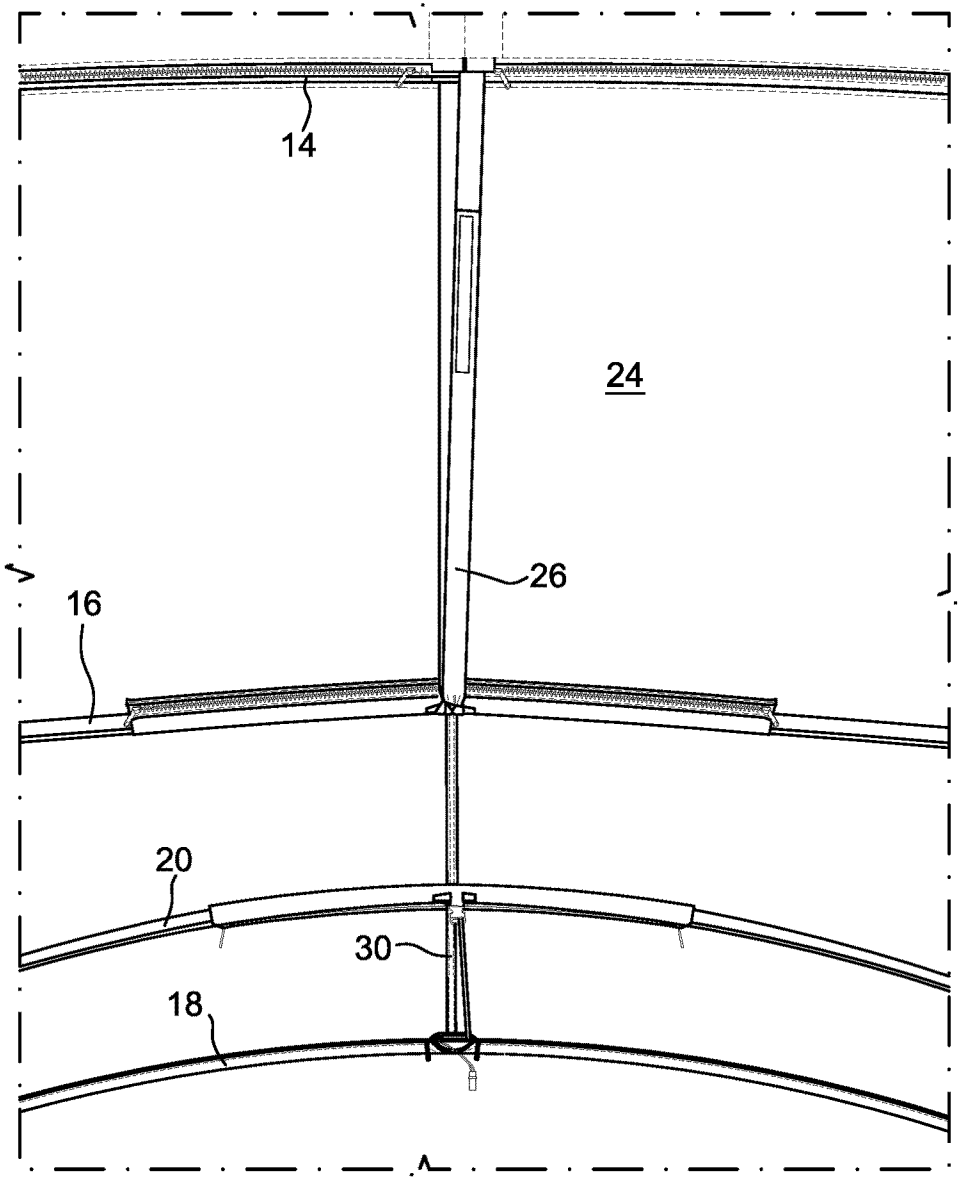
FIG. 2 shows an underside of the bimini top canopy.
Figure 3:
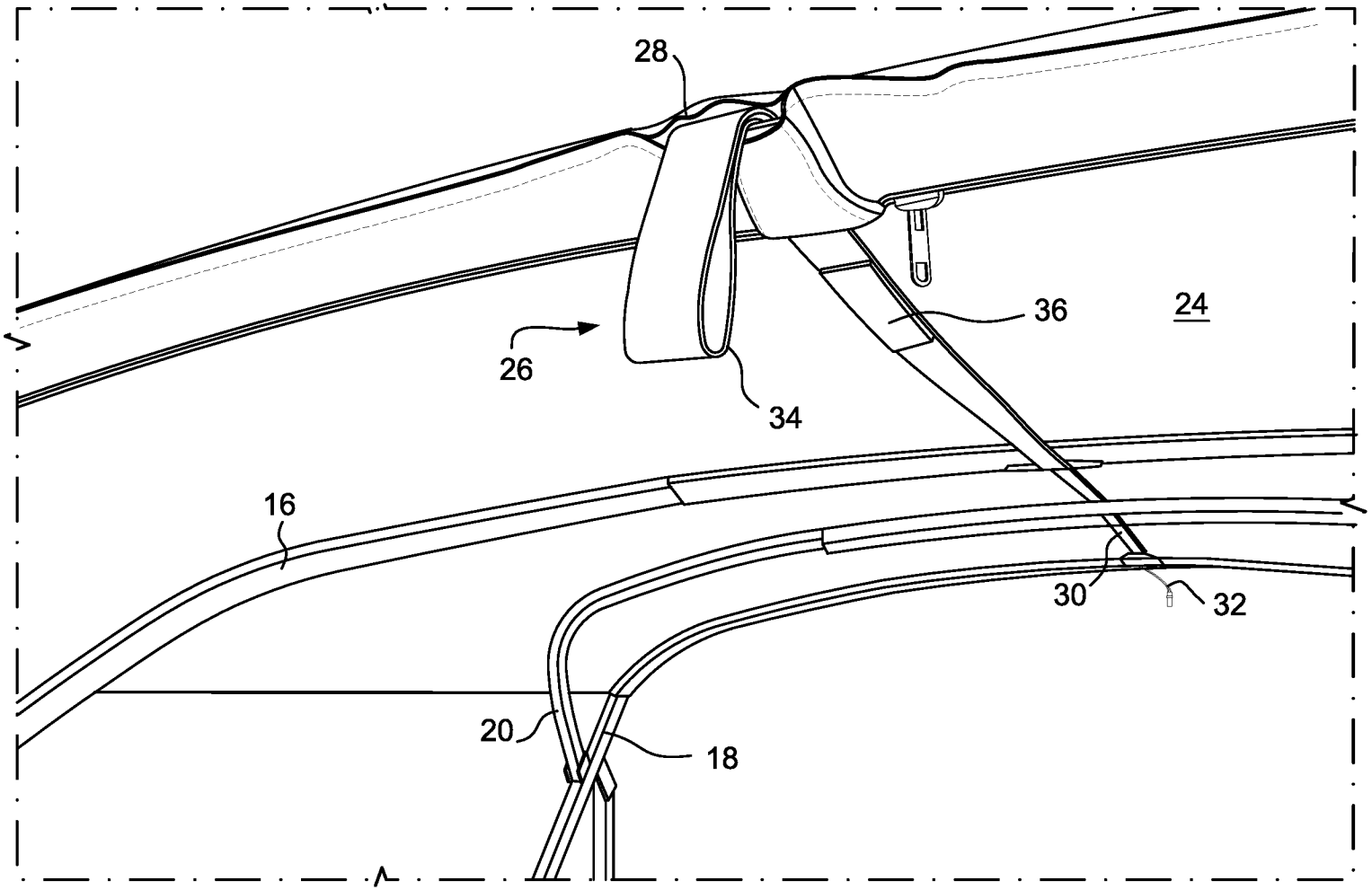
FIG. 3 is a close-up view of the assist strap.
Figure 4:
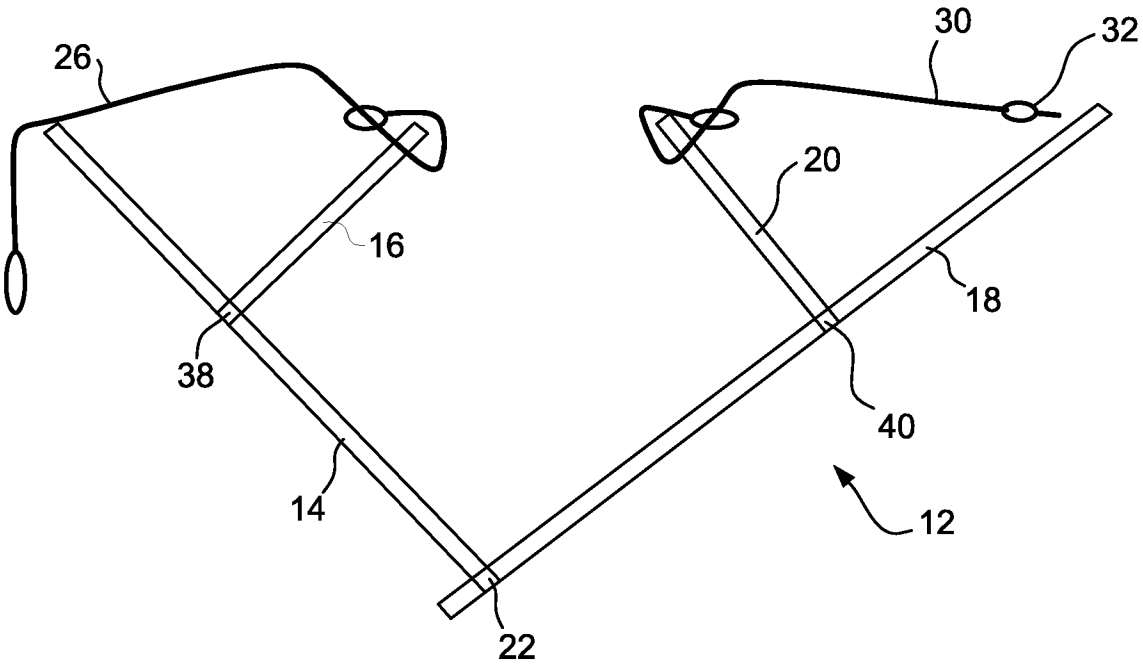
FIG. 4 is a schematic illustration of the bimini frame and fold assist system.

With reference to FIGS. 2-4, an assist strap 26 is connected to the front support 16 and is contained between the front bow 14 and the canopy 24. In the embodiment shown, the assist strap 26 is threaded over the front bow 14 and through a front access opening 28 in the canopy 24. An assist bungee 30 is connected to the rear support 20 and is selectively attachable to the rear bow 18. In some embodiments, the rear bow 18 may be provided with the male or female part of a snap connector, where an end of the assist bungee 30 is provided with a complementary female or male part of the snap connector. The assist bungee 30 may also be provided with a toggle 32 that serves to adjust the tension of the assist bungee 30 with the bimini frame 12 in its extended position. The assist bungee 30 biases the rear support 20 toward the retracted position of the bimini frame 12.

The front bow 14 and the rear bow 18 generally include two legs and a crossbar connected between the two legs. The assist strap 26 engages the crossbar of the front bow 14, and the assist bungee 30 engages the crossbar of the rear bow 18.

The assist strap 26 may be provided with one part 34 of a hook and loop fastener on a handle portion with a corresponding part 36 of the hook and loop fastener farther up the strap 26. The hook and loop fastener 34, 36 enables the strap 26 to be stowed up against the canopy 24 when not in use. The second part 36 of the hook and loop fastener may alternatively be connected to the canopy 24 directly.

With continued reference to FIG. 4, the front support 16 is pivotably attached to the front bow 14 at a front pivot joint 38. The assist strap 26 is secured to the front support 16 at a position spaced from the front pivot joint 38. Similarly, the rear support 20 is pivotably attached to the rear bow 18 at a rear pivot joint 40. The assist bungee 30 is secured to the rear support 20 at a position spaced from the rear pivot joint 40. When the bimini frame is released from the deck surface except for the deck pivot joint 22, for example by detaching the front and rear stanchions 15, pulling downward on the assist strap 26 serves to displace the front support 16 toward the front bow 14 as the front bow 14 is displaced toward the rear bow 18 to thereby pivot the bimini frame 12 on the deck pivot joint 22 toward the retracted position. In a similar context, with the bimini frame 12 detached from the deck surface except for the deck pivot joint 22, the assist bungee 30 displaces the rear support 20 toward the rear bow 18 on the rear pivot joint 40 via the elastic bias of the assist bungee 30, thereby facilitating displacement of the bimini frame 12 to the retracted position.

In order to displace the bimini top 10 to the retracted position, the operator detaches the bimini frame 12 from the deck surface except for the deck pivot joint 22. In the exemplary bimini frame shown in FIG. 1, the operator would release the front and rear stanchions 15 and stow the stanchions adjacent the front bow 14 and the rear bow 18 via brackets 25, respectively. Once released, the assist bungee 30 begins to draw the rear support 20 toward the rear bow 18 via its elastic bias. The operator can subsequently displace the assist strap 26 downward and rearward to displace the front support 16 toward the front bow 14 and to displace the front bow 14 toward the rear bow 18 via the deck pivot joint 22. In some configurations, after fully extending the assist strap 26, the operator may manually displace the bimini frame 12 to the fully retracted position. Once in the fully retracted position, the canopy can be secured in a canopy boot.

The assist strap 26 with its integrated handle provides the user more control when deploying or stowing the bimini top compared to prior systems, particularly if the user is operating the bimini top in windy conditions. The addition of the hook and loop fastener 34, 36 prevents the assist strap 26 from flapping in the wind or being open to catch on an object while the boat is in motion. Still further, the assist bungee 30 being located at the back end of the bimini frame (rather than at the front and back ends or across the entire canopy) is safer for the user so that the bimini frame is not snapping backwards when released from the deck (e.g., via the stanchions). The system also allows the front and rear supports to retract during the storage process to prevent bow "scissoring" and resulting fabric pinch damage.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A fold assist bimini top comprising:

a bimini frame including a front bow, a front support, a rear bow, and a rear support;

a canopy secured over the bimini frame;

an assist strap connected to the front support and contained between the front bow and the canopy, wherein the assist strap is threaded over the front bow; and an assist bungee connected to the rear support and attachable to the rear bow, wherein the bimini frame is displaceable between an extended position and a retracted position, wherein the assist bungee biases the rear support toward the retracted position, and wherein a forward end of the assist strap is accessible when the bimini frame is in the extended position.

2. A fold assist bimini top according to claim 1, wherein the assist strap is displaceable relative to the front bow.

3. A fold assist bimini top according to claim 2, wherein the assist strap and the front support are configured such that displacement of the assist strap relative to the front bow displaces the front support relative to the front bow.

4. A fold assist bimini top according to claim 2, wherein the assist bungee and the rear support are configured such that displacement of the assist strap relative to the front bow activates the assist bungee to displace the rear support relative to the rear bow.

5. A fold assist bimini top according to claim 1, wherein the front support is pivotably attached to the front bow at a front pivot joint, and wherein the assist strap is secured to the front support at a position spaced from the front pivot joint.

6. A fold assist bimini top according to claim 1, wherein the rear support is pivotably attached to the rear bow at a rear pivot joint, and wherein the assist bungee is secured to the rear support at a position spaced from the rear pivot joint.

7. A fold assist bimini top according to claim 1, wherein the assist bungee is selectively attachable to the rear bow.

8. A fold assist bimini top according to claim 1, wherein the assist bungee comprises a snap connector, and wherein the assist bungee is snap-connected to the rear bow.

9. A fold assist bimini top according to claim 1, wherein the assist bungee comprises a toggle.

10. A fold assist bimini top according to claim 1, wherein the assist strap or the canopy comprises a first part of a releasable connector on an inside surface, and wherein an end of the assist strap comprises a second part of the releasable connector that is selectively engageable with the first part.

11. A fold assist bimini top according to claim 1, wherein the front bow comprises two legs and a cross bar connected between the two legs, and wherein the assist strap engages the cross bar of the front bow.

12. A fold assist bimini top according to claim 1, wherein the assist strap is threaded through a front access opening in the canopy.

13. A fold assist bimini top comprising:

a bimini frame including a front bow, a front support, a rear bow, and a rear support, the bimini frame being displaceable between an extended position and a retracted position;

a canopy secured over the bimini frame and displaceable with the bimini frame between the extended position and the retracted position; and a pair of assist straps that are configured to facilitate displacement of the bimini frame from the extended position to the retracted position, one of the pair of assist straps being manually displaceable, and one of the assist straps being elastic and being secured at ends thereof to the bimini frame, wherein the elastic assist strap biases the bimini frame toward the retracted position, and wherein a forward end of the manually displaceable strap comprises a handle.

14. A fold assist bimini top according to claim 13, wherein the elastic assist strap comprises a bungee cord.

15. A fold assist bimini top according to claim 13, wherein the manually displaceable assist strap is connected between the front bow and the front support or between the rear bow and the rear support, and wherein the elastic assist strap is connected between the rear bow and the rear support or between the front bow and the front support.

16. A fold assist bimini top according to claim 13, wherein the front support is pivotably secured to the front bow at a front pivot joint, and wherein the rear support is pivotably secured to the rear bow at a rear pivot joint, wherein the pair of assist straps are respectively connected to the front support and the rear support at positions spaced from the front and rear pivot joints.

17. A fold assist bimini top according to claim 13, wherein the elastic assist strap comprises a toggle.

18. A method of displacing a bimini top supported on a deck surface via a deck pivot joint to a retracted position, the bimini top including a bimini frame with a front bow, a front support, a rear bow, and a rear support, a canopy secured over the bimini frame, an assist strap connected to the front support and threaded over the front bow and through a front access opening in the canopy, and an assist bungee connected to the rear support and selectively attachable to the rear bow, the method comprising:

(a) detaching the bimini frame from the deck surface except for the deck pivot joint; and (b) pulling downward on the assist strap to displace the front bow toward the rear bow and pivoting the bimini frame on the deck pivot joint toward the retracted position.

19. A method according to claim 18, further comprising, after step (b), manually displacing the bimini frame to the retracted position.

20. A method according to claim 18, further comprising biasing the rear support toward the rear bow with the assist bungee.

* * * * *